US009108192B2

(12) United States Patent
Weber et al.

(10) Patent No.: US 9,108,192 B2
(45) Date of Patent: Aug. 18, 2015

(54) MICRO RESERVOIR, PARTICULARLY FOR INTEGRATION IN A MICROFLUIDIC FLOW CELL

(71) Applicant: thinXXS Microtechnology AG, Zweibruecken (DE)

(72) Inventors: Lutz Weber, Zweibruecken (DE); Michel Neumeier, Mandelbachtal (DE); Stefan Keck, Kirkel (DE)

(73) Assignee: THINXXS MICROTECHNOLOGY AG, Zweibrücken (DE)

( * ) Notice: Subject to any disclaimer, the term of this patent is extended or adjusted under 35 U.S.C. 154(b) by 57 days.

(21) Appl. No.: 13/917,284

(22) Filed: Jun. 13, 2013

(65) Prior Publication Data

US 2014/0000735 A1 Jan. 2, 2014

(30) Foreign Application Priority Data

Jun. 28, 2012 (EP) ..... 12173976

(51) Int. Cl.
*B01L 3/00* (2006.01)

(52) U.S. Cl.
CPC ..... *B01L 3/50* (2013.01); *B01L 3/5027* (2013.01); *B01L 3/50273* (2013.01); *B01L 2300/0809* (2013.01); *B01L 2300/123* (2013.01)

(58) Field of Classification Search
CPC ..... B01L 3/50; B01L 3/00; B01L 3/5027; B01L 2300/044; B01L 2400/0481; B01L 2200/027; B01L 2200/16; B01L 3/50273; B01L 2300/123; B01J 19/00; B65D 75/36
USPC ..... 422/502, 503, 504, 505; 222/207, 214, 222/541.6, 541.7
See application file for complete search history.

(56) References Cited

U.S. PATENT DOCUMENTS

| | | | | |
|---|---|---|---|---|
| 3,635,376 | A * | 1/1972 | Hellstrom | 222/107 |
| 4,592,493 | A | 6/1986 | Smith | |
| 6,929,239 | B1 * | 8/2005 | Colin et al. | 251/115 |
| 7,135,147 | B2 * | 11/2006 | Cox et al. | 422/502 |
| 7,159,618 | B2 * | 1/2007 | Broyer et al. | 137/828 |
| 7,198,759 | B2 * | 4/2007 | Bryning et al. | 422/504 |
| 8,795,607 | B2 * | 8/2014 | Kurowski et al. | 422/550 |
| 2007/0041878 | A1 * | 2/2007 | Bryning et al. | 422/103 |
| 2010/0308051 | A1 | 12/2010 | Weber | |
| 2011/0186466 | A1 * | 8/2011 | Kurowski et al. | 206/524.6 |
| 2012/0214254 | A1 * | 8/2012 | Schmidt et al. | 436/174 |
| 2013/0118621 | A1 * | 5/2013 | Weber et al. | 137/803 |

FOREIGN PATENT DOCUMENTS

| | | |
|---|---|---|
| DE | 10336850 | 3/2005 |
| WO | 2009071078 | 6/2009 |
| WO | 2009152952 | 12/2009 |

* cited by examiner

*Primary Examiner* — Patrick M Buechner
(74) *Attorney, Agent, or Firm* — Lucas & Mercanti, LLP; Klaus P. Stoffel

(57) ABSTRACT

A micro reservoir, particularly for integration in a microfluidic flow cell, with a storage space for receiving a fluid and being in connection with an outlet duct for the fluid, wherein a cancelable lock for the fluid is formed. A mechanism is provided for canceling the lock without pressure of the fluid acting on the lock. The mechanism preferably mechanically destroys the lock.

16 Claims, 5 Drawing Sheets

MICRO RESERVOIR, PARTICULARLY FOR INTEGRATION IN A MICROFLUIDIC FLOW CELL

CROSS-REFERENCE TO RELATED APPLICATIONS

The present application claims priority of EP 12 173 976.7, filed Jun. 28, 2012, the priority of this application is hereby claimed and this application is incorporated herein by reference.

BACKGROUND OF THE INVENTION

The invention relates to a micro reservoir, particularly for integration in a microfluidic flow cell, with a storage space containing a fluid, wherein the storage space is in communication with an outlet duct for the fluid in which a cancelable lock for the fluid is formed.

Micro reservoirs of this type are known from WO2009/071078 A1. The storage space and the outlet duct of this known micro reservoir are formed by two foils arranged on a plate-shaped substrate, wherein the foils are welded or/and glued together so as to define the storage space and the outlet duct. For forming the storage space, the foil facing away from the substrate has a spherically shaped deformation. A welded or/and glued connection of the foils extending linearly transversely of the outlet duct serves as a lock which hermetically tightly seals the storage space. The storage space is formed by a deep drawn expansion of the foil facing the substrate. For opening the storage space, the storage space is pressed together with a deformation of the foil until such a pressure is built up at the lock provided as an intended breaking point, causing a rupture of the intended breaking point.

The substrate constructed as a single piece forms a portion of a processing device for fluids (flow cell) which, in addition to one or several micro reservoirs, may comprise further elements for processing fluids. Among these are elements for supplying liquid or gaseous specimens, mixing elements, pumps, valves, filters for separating components of a fluid, temperature adjusting chambers, detection chambers, lateral flow test strips, transport ducts and waste chambers which, individually or in combination, are used for the analysis and/or synthesis of fluids for medical and pharmaceutical purposes or for analytical processes, such as immune or genetic assays.

Disadvantageously, the fluid pressure required for eliminating the lock causes the fluid to shoot out of the storage space at a high flow speed in the first moment after opening the outlet duct. A partial quantity of the stored fluid leaves the storage space in this manner uncontrolled and unmetered. If the flow cell is intended for reactions which require defined flow speeds of supplied reagents, this partial quantity is lost and, thus, the contents of the micro reservoir cannot be fully utilized.

It is a particular disadvantage that with decreasing total storage quantity the non-usable portion increases, so that especially expensive reagents are lost.

SUMMARY OF THE INVENTION

The invention is based on the object to provide a novel micro reservoir of the above mentioned type which facilitates a controlled and dosed removal of the stored fluid from the outset.

The micro reservoir meeting this object in accordance with the invention is characterized by means for eliminating the lock without admitting the pressure of the fluid to the lock.

In accordance with the invention, the lock can be eliminated with the entire storage quantity remaining in the storage space. A controlled and dosed removal of fluid from the reservoir can take place from the beginning after opening the lock.

While the elimination of a lock, for example, by the influence of heat would be conceivable, the means for elimination of the lock preferably comprise devices for mechanically destroying the lock.

Such devices are used in particular if, in accordance with an embodiment of the invention, the lock is formed by welding or/and gluing oppositely located limiting walls of the outlet duct, and at least one of these two limiting walls is of a flexible foil.

The devices for mechanically destroying the lock may be comprised of an actor element which separates the welded or/and glued limiting walls, wherein this actor element may be provided for arrangement outside of the outlet duct or within the outlet duct on a side of the lock facing away from the storage space.

In a particularly preferred embodiment of the invention, the at least one flexible foil is arranged on a substrate and the actor element can be pressed through a passage opening in the substrate and against the foil so as to produce a tearing force which eliminates the lock.

In particular, the outlet duct may be formed between two flexible foils which rest against each other and the foil facing the substrate can be connected to the substrate, wherein the actor element lifts the foils from each other while producing the tearing force over the width of the duct by expanding the foils with different radii.

In accordance with a useful feature, the actor element, preferably constructed as a pin, acts on the foil on the side of the lock facing away from the storage space. In particular, this takes place in an area adjacent the outlet duct in which the foil is not connected, either with the substrate, or with any possibly additionally provided foil.

It is understood that the actor element can be a component part of the device for operating the micro reservoir component or the flow cell.

Advantageously, the actor element arranged within the outlet duct includes an impact element movable toward the lock by deforming the actor element, wherein the impact element opens the lock from the side facing away from the storage space.

In particular, this actor element is constructed so as to be arc shaped and the impact element can be moved outwardly by stretching of the arc.

The actor element can be held in an expansion of the foil forming the limiting wall of the outlet duct in a positively locking manner at an end facing away from the impact end, so that when the arc is stretched, essentially only the impact element intended for opening the lock is moved.

In accordance with a further development of the invention, the actor element comprises a lever connected to the outer side of the flexible foil for producing a tearing off force which cancels the lock.

In accordance with another embodiment of this principle, the actor element may comprise a rod element which forms two such levers and intersects the outlet duct, wherein the end of the rod element is rotatable about a point of rotation formed by the substrate by bending the rod element so as to form the tearing off force.

While the ends of the rod could protrude beyond the edges of the substrate, in accordance with a preferred embodiment, two openings are provided in the substrate into which the ends can be pressed as the rod element is being bent.

The actor element provided within the outlet duct or/and the area of the outlet duct in flow direction behind the lock may have adhering to it a dry reagent which is re-suspended when the fluid flows out.

The transport of the fluid out of the storage space may be carried out as an alternative to the deformation of a foil forming the reservoir by means of the application of pneumatic or/and hydraulic pressure.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 12:
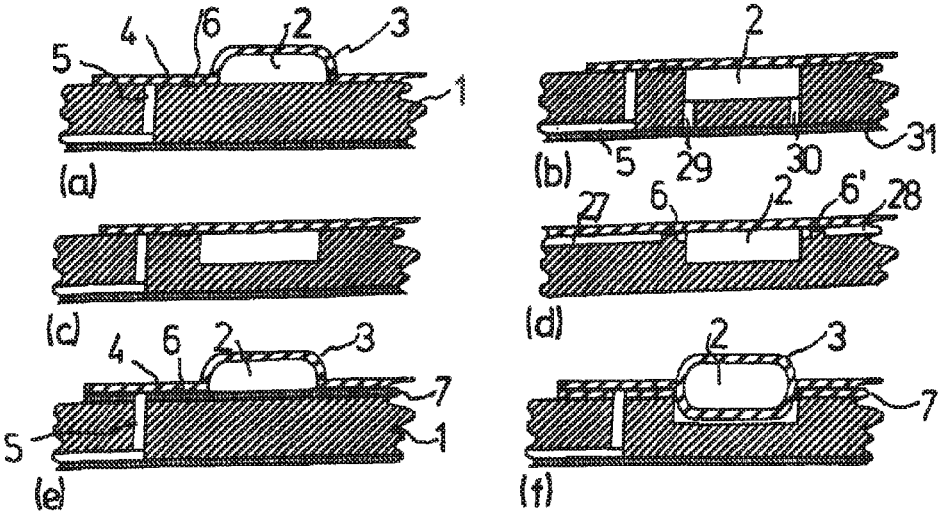
FIG.12 Prior Art
FIG. 12 shows various embodiments of micro reservoirs according to the state of the art.

Initially, reference is made to FIG. 12 wherein, in partial Figures (a) through (f), conventional micro reservoirs are shown in which a microfluidic flow cell is integrated with a substrate 1. Preferably, the substrate is composed of a synthetic material and is manufactured by injection molding.

In accordance with the examples (a) through (d), a storage space 2 for a fluid is formed between the substrate 1 and a foil 3 welded or/and glued to the substrate by an indentation in the foil (FIG. 12*a*) or in the substrate (FIGS. 12*b* through *d*).

An outlet duct 4 connected to the storage space 2, which ends at a duct 5 leading through the substrate 1, is formed by not connecting the foil 3 to the substrate 1 in the area of the duct 4.

A lock 6 is formed for the fluid in the storage space 2 through which the storage space 2 is hermetically sealed by welding or/and gluing the foil 3 to the substrate 1 in an area traversing the duct 4.

In the example of FIG. 12*d*, two outlet ducts each having a lock 6 or 6' are formed which delimit the storage space 2 against a supply duct 27 or a discharge duct 28. After opening the locks 6 or 6', pneumatic or hydraulic pressure applied to the locks transports the fluid from the storage space 2 through the supply duct 27 into the discharge duct 28 for further processing.

In the examples of FIGS. 12*e* and 12*f*, the storage space 2 is located between the foil 3 and another foil 7 connected to the substrate 1. In the examples 12*a* through 12*d* the foil 3 is welded or/and glued to the foil 7 in the same manner as the foil 3 is welded and/or glued to the substrate 1. As is the case in the preceding examples, an outlet duct 4 with a lock 6 is formed by omitting welding or gluing in the area of the duct.

In the example of FIG. 12*f*, the storage space 2 is formed between an indentation in the foil 3 and an indentation in the foil 7, wherein the indentation of the foil 7 protrudes into an indentation formed in the substrate 1.

In the example of FIG. 12*b*, a duct shaped storage space 2 is additionally provided with a filling duct 29 and a ventilating duct 30. After connecting the foil 3 defining the storage space 2 to the substrate 1 and manufacturing the line shaped lock 6 by means of welding, the fluid to be stored is introduced by dispensing or by pumping into the filling duct 29 and the storage space is completely filled. In this case, air in the storage space can escape through the ventilating duct 30. After filling, the filling duct 29 and the ventilating duct 30 are hermetically sealed by means of a bottom foil 31 glued or welded to the substrate 1. The bottom foil 31 simultaneously serves as fluid-tight cover of the transport duct 5.

It is understood that the various features of the storage according to examples 12*a* through 12*f* can be combined with each other in order to form further embodiments of fluid reservoirs.

Preferably, the foils 3, 7 consist of a synthetic material, of aluminum, or of a composite of synthetic material and aluminum. In particular, there is agreement between the synthetic material of the composite foil of synthetic material and aluminum and the synthetic material of the substrate, wherein, for example, thermoplastic materials, such as PP, PE, COC, COP, PC, PMMA and PEEK can be considered.

In the examples 12*a* through 12*f* described above, the storage space 2 is emptied by displacing the liquid or gaseous fluid contained in the storage space by deforming the foil 3. As the fluid is being displaced it penetrates the unconnected duct area between the foil 3 and the substrate 1 or between the foil 3 and the further foil 7 and rests with pressure against the lock 6. When the fluid pressure is sufficiently high, the lock 6 breaks apart and the fluid penetrates further as the duct cross section opens until the fluid flow reaches the duct 5.

Disadvantageously, immediately after the lock 6 breaks up under high pressure, fluid under high pressure is discharged from the storage space 2 and flows out uncontrolled at a high flow speed.

In the micro reservoirs described in FIGS. 1 through 11, such an uncontrolled discharge is avoided during breakage of the lock 6.

Figure 1:
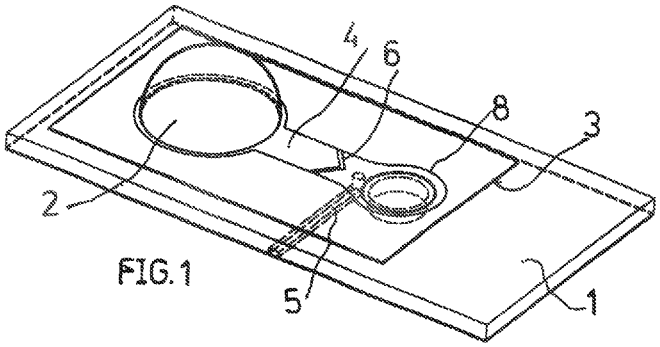
FIG. 1 shows a first embodiment of a micro reservoir according to the invention in a perspective illustration.

A micro reservoir illustrated in FIG. 1, corresponding to the example of FIG. 12*a*, with a substrate 1 and a storage space 2 formed between a foil 3 and the substrate 1 by the foil 3 being welded or/and glued to the substrate 1 has, downstream of a discharge duct 4 which ends at a duct 5 penetrating through the substrate 1, another area 8 in which the foil 3 is not welded or/and glued as is the case in the discharge duct 4. This area 8 is aligned toward a throughopening 9 in the substrate 1. An elastic diaphragm 11 welded or/and glued to the substrate 1 is placed in an indentation 10 of the throughopening 9.

A foil 12 covers the substrate on the side facing opposite the storage space 2 so as to close off a portion of the duct 5.

Figure 2:
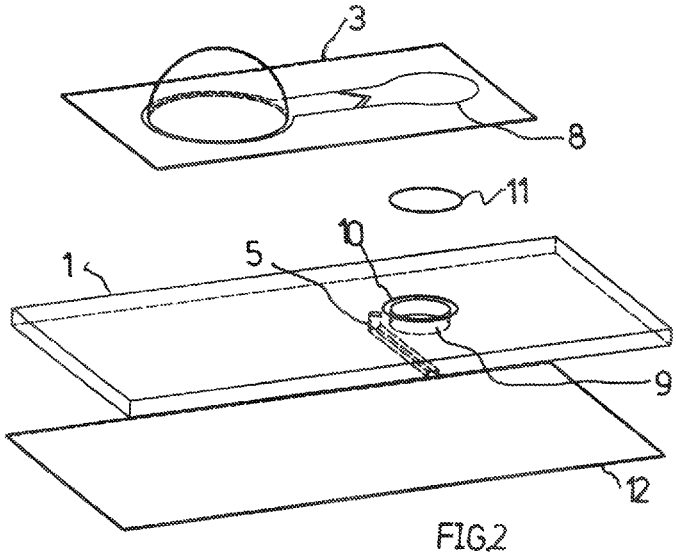
FIG. 2 is an exploded view of the micro reservoir of FIG. 1.

An operating device to be used together with the reservoir of FIGS. 1 and 2 comprises, in addition to an actor 13 for deforming the foil 3 in the area of the storage space 2, a pin shaped actor element 14 which can be inserted into the opening 9 in the substrate 1 and can be pressed against the elastic diaphragm 11 so as to cause deformation of the diaphragm 11. As a result of the deformation of the diaphragm 11, the foil 3 is lifted in the unconnected area 8 arranged so as to follow the duct 4, wherein this lifting action continues up into the duct 4. This produces a tearing off force which breaks up the lock 6.

The storage space 2 can now be emptied in a dosed manner by means of the actor 13. The foil 3, which prior to emptying of the storage space 2 rests against the substrate 1, is lifted as a result of the penetration of the fluid while forming a duct cross section. A dosed dispensing of fluid from the storage space 2 is possible from the beginning with the use of the entire reservoir contents.

Another actor element 15, which can be placed against the foil 3 from a side of the micro reservoir opposite the actor element 14 presses, after opening the lock 6, the foil 3 against the substrate 1, so that fluid from the duct 4 cannot penetrate into the unconnected area 8.

The elastic diaphragm 11 which closes the throughopening 9 could possibly be omitted if the throughopening 9 has been exactly sealed to a sufficient extent by pressing the additional actor element 15 against the foil 3.

Figure 3:
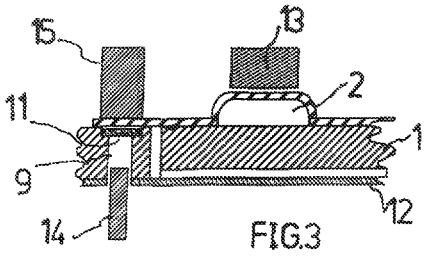
FIG. 3 is an illustration explaining the manner of operation of the micro reservoir according to the invention.
Figure 4:
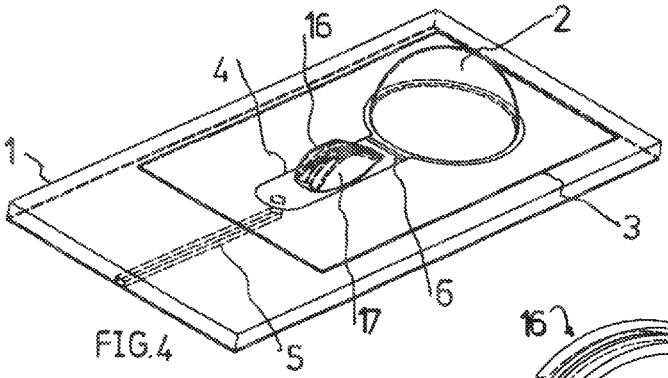
FIG. 4 is a perspective view of a second embodiment of a micro reservoir according to the invention.
Figure 5:
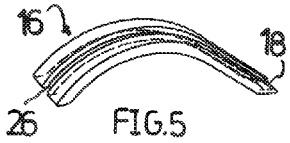
FIG. 5 is an actor element used with the micro reservoir of FIG. 4.
Figure 6:
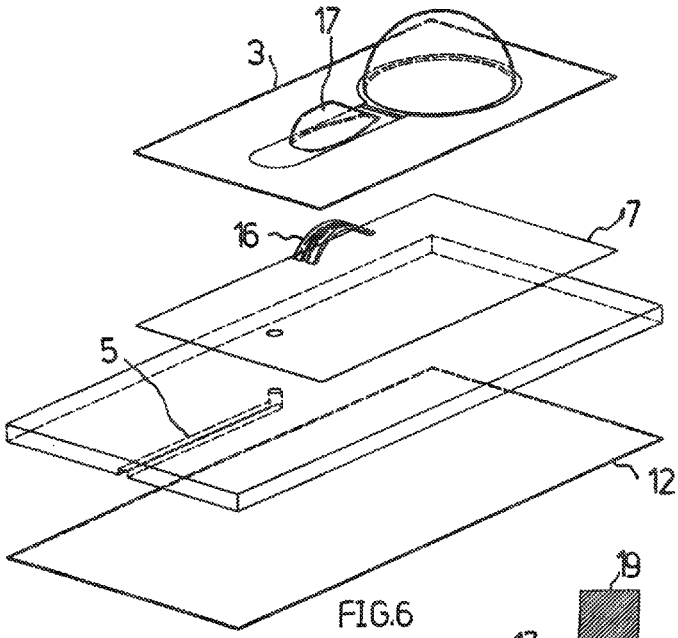
FIG. 6 is an exploded view of the micro reservoir of FIG. 4.

While in the embodiment shown in FIGS. 1 to 3 the pin shaped actor element 14 arranged outside of the outlet duct 4 is used, an embodiment corresponding to the reservoir of FIG. 12*e* is shown in FIGS. 4 to 7 with an actor element 16 arranged within an outlet duct 4. The actor element 16, separately illustrated in FIG. 5, is received in an outwardly bulging portion 17 of the foil 3, wherein the outwardly bulging portion 17 is manufactured by deep drawing, together with the deformation provided for forming the storage space 2. The actor element 16 is constructed arc shaped with a leading wedge 18 which tapers toward an end of the arc.

Preferably, the actor element 16 has a groove on its upper side or lower side; in the present case, the groove 26 is on its upper side. In the pressed in and stretched condition the groove forms a duct area which is limited by the actor element 16 and the pressed on foil 3 or foil 7, and through which the fluid can reach the duct 5 from the storage space 2.

The actor element 16 preferably is composed of synthetic material, particularly the same synthetic material as the substrate, and is manufactured by injection molding. In another embodiment, the actor element 16 can be made of a form reservoir alloy or a bimetal, wherein in these cases stretching of the actor element takes place as a result of the supply of heat.

Figure 7:
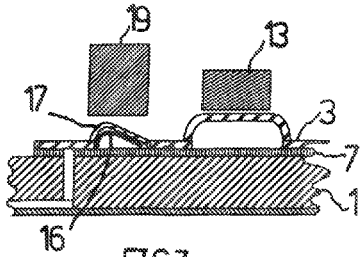
FIG. 7 is an illustration explaining the manner of operation of the micro reservoir of FIG. 4.
Figure 8:
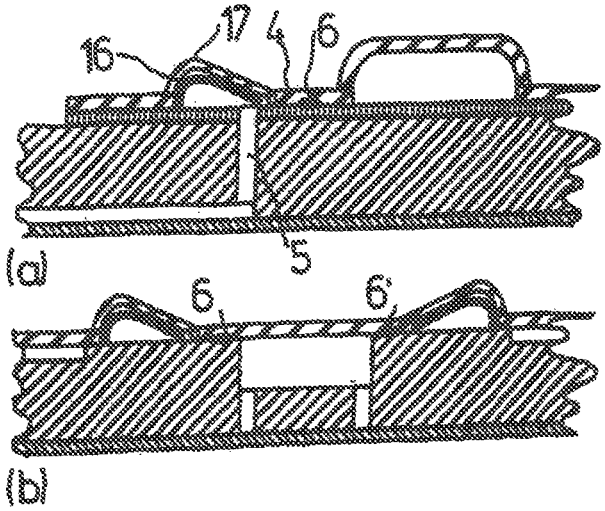
FIG. 8 shows a modification of the micro reservoir of FIG. 4.

As seen in FIG. 7, an operating device has, in addition to an actor 13 for deforming the foil 3 in the area of the storage space 2, another actor 19 by means of which the arc shaped actor element 16 can be pressed together and stretched, so that the leading wedge 18 pushes through the lock 6, while the other end of the arc shaped actor element is held in the outwardly bulging portion 17 in a positively locking manner.

After opening the lock 3, fluid can be transferred from the storage space 2 to the duct 5 in a dosed manner with the help of the actor 13.

While for dosing the fluid the actor 13 is moved in a controlled manner preferably by a motor or a magnetic drive, the actor 19 may be rigidly connected to a clamping device which is a portion of a device for operating the flow cell. When closing the clamping device, the actor 19 presses against the outwardly bulging portion 17 of the foil 3 and, thus as a result, the actor element 16. It is understood that for this purpose the flow cell must be mechanically supported on its bottom side.

While in the embodiment of FIGS. 4 to 7, the outwardly bulging portion 17 receiving the actor element 16 which is located in the duct 4 can be utilized to receive, in addition to the actor element 16, a reagent, particularly a dry reagent, in the embodiment shown in FIG. 8*a* the bulging portion 17 is essentially placed in an area which is downstream of the end of the duct 4 in which the foils 3 and 4 are not welded or/and glued to each other.

In the embodiment of FIG. 8*b*, two outlet ducts are provided with a lock 6 or 6' which can be destroyed by an actor element 16 or 16', respectively. After both locks have been destroyed, the reservoir can be emptied by means of pneumatic or hydraulic pressure without deforming the foil defining the storage space.

Figure 9:
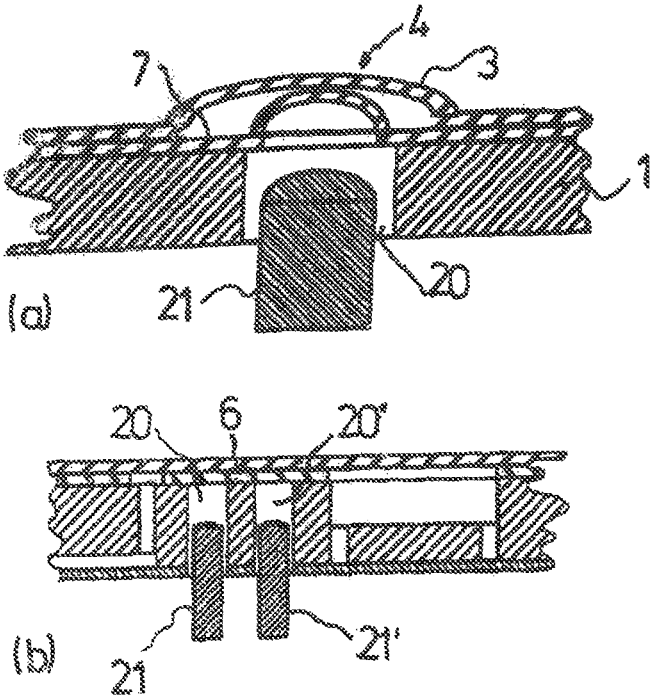
FIG. 9 shows a third embodiment of a micro reservoir according to the invention in a partial view.

In accordance with the embodiment of FIG. 9, instead of the actor element 16 arranged within the duct 4 which is visible in FIG. 9*a* in cross section, also a throughopening 20 could be formed in the substrate 1 into which could be inserted an actor element 21 which widens the foil 7 in the area of the duct 4, wherein the widened foil 7 lifts the foil 3 near the lock (not shown in FIG. 9*a*) and produces a tearing off force.

As shown in FIG. 9*b*, an opening 20' for an actor element 21' corresponding to the throughopening 20 can also be additionally provided in front of the lock 6.

Figure 10:
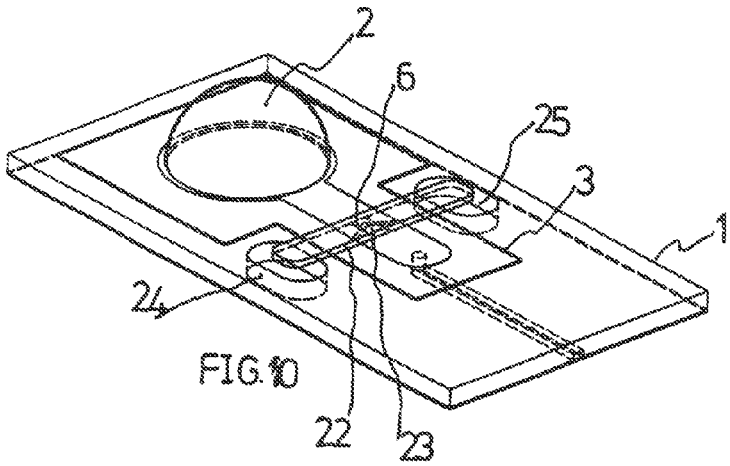
FIG. 10 shows a fourth embodiment of a micro reservoir according to the invention in a perspective view.
Figure 11:
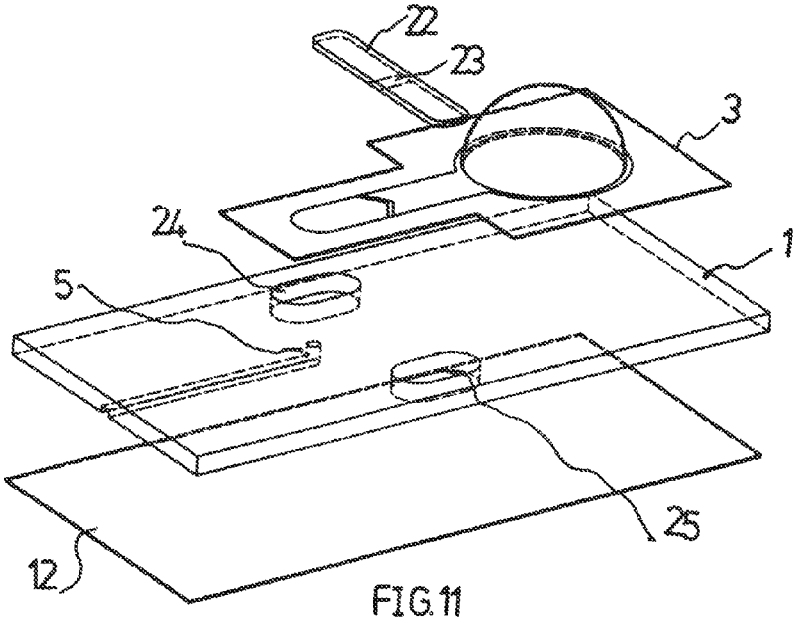
FIG. 11 is an exploded view of the micro reservoir of FIG. 10.

A micro reservoir illustrated in FIGS. 10 and 11 includes a rod shaped actor element 22 which intersects the area of the outlet duct 4 in which the foil 3 is not connected to the substrate 1, and is glued or/and welded to the outer side of the foil 3 at 23. Throughopenings 24 and 25 in the substrate 1 permit bending of the actor element by pressing its ends into the throughopenings 24, 25, so that a tearing off force is produced which cancels the lock 6.

While specific embodiments of the invention have been shown and described in detail to illustrate the inventive principles, it will be understood that the invention may be embodied otherwise without departing from such principles.

We claim:

1. A micro reservoir for integration in a microfluidic flow cell, comprising:

a storage space receiving a fluid;

an outlet duct for the fluid, the outlet duct being connected to the storage space;

a lock capable of being canceled is provided in the outlet duct for the fluid; and means for canceling the lock without any pressure of the fluid acting on the lock, wherein the lock is formed by welding or/and gluing two oppositely located limiting walls of the outlet duct.

2. The micro reservoir according to claim 1, wherein the means for canceling the lock includes devices for mechanically destroying the lock.

3. The micro reservoir according to claim 1, wherein at least one of the two limiting walls is formed by a flexible foil.

4. The micro reservoir according to claim 3, wherein the devices for mechanically destroying the lock comprise a welded or/and glued actor element which separates the welded or/and glued limiting walls.

5. The micro reservoir according to claim 4, wherein the actor element is arranged outside of the outlet duct or within the outlet duct.

6. The micro reservoir according to claim 5, wherein the actor element is provided on a side of the lock facing away from the storage space.

7. The micro reservoir according to claim 5, wherein the at least one flexible foil is arranged on a substrate and the actor element is pressable against the foil through a throughopening in the substrate for producing a tearing off force which cancels the lock.

8. The micro reservoir according to claim 7, wherein the outlet duct is formed between two flexible foils which rest against each other and the foil facing the substrate is connected to the substrate, wherein the actor element lifts the foils off each other while producing the tearing off force over a width of the duct.

9. The micro reservoir according to claim 8, wherein the actor element is pressable against the foil on a side of the lock facing away from the storage space in an area arranged downstream of the outlet duct.

10. The micro reservoir according to claim 5, wherein the actor element is a component of a device for operating the micro reservoir or the flow cell.

11. The micro reservoir according to claim 5, wherein the actor element is arranged within the outlet duct and has an impact element movable by deformation of the actor element against the lock, wherein the actor element is constructed arc shaped and the impact element is movable by stretching the arc.

12. The micro reservoir according to claim 11, wherein the actor element is held in a positively locking manner in a widened portion of the foil forming the limiting wall of the outlet duct at an end facing away from the impact element.

13. The micro reservoir according to claim 4, wherein the actor element comprises a lever connected to an outer side of the flexible foil for producing a tearing off force canceling the lock.

14. The micro reservoir according to claim 13, wherein the actor element comprises a further lever and a rod element that forms the two levers and intersects the outlet duct, wherein ends of the rod element are each rotatable in order to produce the tearing off force by bending the rod element about a fulcrum formed by the substrate, wherein the two ends are each be pressable into an opening in the substrate.

15. The micro reservoir according to claim 5, wherein the actor element is provided within the outlet duct, and the actor element or/and an area of the outlet duct after the lock in flow direction is provided with a dry reagent.

16. The micro reservoir according to claim 1, wherein the fluid is transported out of the storage space by pneumatic or/and hydraulic pressure.

* * * * *